US011067941B2

(12) United States Patent
Shirai et al.

(10) Patent No.: US 11,067,941 B2
(45) Date of Patent: Jul. 20, 2021

(54) IMAGE FORMING APPARATUS INCLUDING A ROLLER SUPPORT UNIT AND A CONTACT PORTION

(71) Applicant: FUJIFILM Business Innovation Corp., Tokyo (JP)

(72) Inventors: Masakazu Shirai, Kanagawa (JP); Koichi Sato, Kanagawa (JP); Kazutoshi Sugitani, Kanagawa (JP); Hibiki Sasaki, Kanagawa (JP); Kaoru Matsushita, Kanagawa (JP); Kiyotoshi Kaneyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/816,926

(22) Filed: Mar. 12, 2020

(65) Prior Publication Data

US 2021/0088943 A1 Mar. 25, 2021

(30) Foreign Application Priority Data

Sep. 24, 2019 (JP) ..... JP2019-172526

(51) Int. Cl.
*G03G 21/16* (2006.01)

(52) U.S. Cl.
CPC ..... *G03G 21/1647* (2013.01); *G03G 21/168* (2013.01); *G03G 2221/1654* (2013.01)

(58) Field of Classification Search
CPC ..... G03G 21/1647; G03G 21/168; G03G 2221/1654
See application file for complete search history.

(56) References Cited

U.S. PATENT DOCUMENTS

2020/0264540 A1* 8/2020 Takai ..... G03G 15/752

FOREIGN PATENT DOCUMENTS

JP 11-161038 A 6/1999

* cited by examiner

*Primary Examiner* — Arlene Heredia
(74) *Attorney, Agent, or Firm* — Sughrue Mion, PLLC

(57) ABSTRACT

An image forming apparatus includes: a roller including a rotational shaft supported by a bearing; a support unit that movably supports the bearing and an attached component of the bearing between a use position of the roller and a retraction position away from the use position; and a contact portion that is provided in one or both of the bearing and attached component, and the support unit, and when the roller is moved to the retraction position, comes into contact with part of the support unit or the attached component opposed to the bearing and the attached component.

14 Claims, 8 Drawing Sheets

IMAGE FORMING APPARATUS INCLUDING A ROLLER SUPPORT UNIT AND A CONTACT PORTION

CROSS-REFERENCE TO RELATED APPLICATIONS

This application is based on and claims priority under 35 USC 119 from Japanese Patent Application No. 2019-172526 filed on Sep. 24, 2019.

BACKGROUND

(i) Technical Field

The present disclosure relates to an image forming apparatus.

(ii) Related Art

Japanese Unexamined Patent Application Publication No. 11-161038 discloses an image forming apparatus including a transfer belt device having a transfer belt that forms a transfer nip part between an image carrier and the transfer belt. In the image forming apparatus, a drive roller bearing, which performs positioning of the transfer belt device with respect to the image forming apparatus, has a two-way shape, the upper part of a receiving portion of the image forming apparatus for receiving the drive roller bearing has a groove shape in a size fitted to a two-way portion of the drive roller bearing, and the lower part of the receiving portion has a hole shape in a size fitted to the bearing outer diameter of the drive roller bearing.

Japanese Unexamined Patent Application Publication No. 11-161038 also shows that with transfer belt device in the configuration described above, when the transfer belt device is attached to, detached from, or replaced in the image forming apparatus, even a general user can smoothly perform the operation without a troublesome operation.

SUMMARY

Aspects of non-limiting embodiments of the present disclosure relate to an image forming apparatus that, when transported in a state where a roller movably provided between a use position and a retraction position is moved to the retraction position, can reduce the impact caused by a collision of an end of a rotational shaft of the roller with attached components present in the vicinity of the end with an interval, by providing a contact portion, as compared with when the contact portion is not provided. The contact portion is provided in one or both of the bearing of the roller, the attached components, and a support unit that movably supports the bearing and the attached components, so that when the bearing and the attached components are moved to the retraction position, the contact portion comes into contact with part of the opposing support unit and bearing.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including:

a roller including a rotational shaft supported by a bearing;

a support unit that movably supports the bearing and an attached component of the bearing between a use position of the roller and a retraction position away from the use position; and a contact portion that is provided in one or both of the bearing and attached component, and the support unit, and when the roller is moved to the retraction position, comes into contact with part of the support unit or the attached component opposed to the bearing and the attached component.

BRIEF DESCRIPTION OF THE DRAWINGS

Exemplary embodiments of the present disclosure will be described in detail based on the following figures, wherein:

FIG. 2A is a schematic cross-sectional view illustrating a state of the first transfer roller when moved to a use position, and FIG. 2B is a schematic cross-sectional view illustrating a state of the first transfer roller when moved to a retraction position;

DETAILED DESCRIPTION

Hereinafter exemplary embodiments of the disclosure will be described with reference to the drawings.

First Exemplary Embodiment

Figure 1:
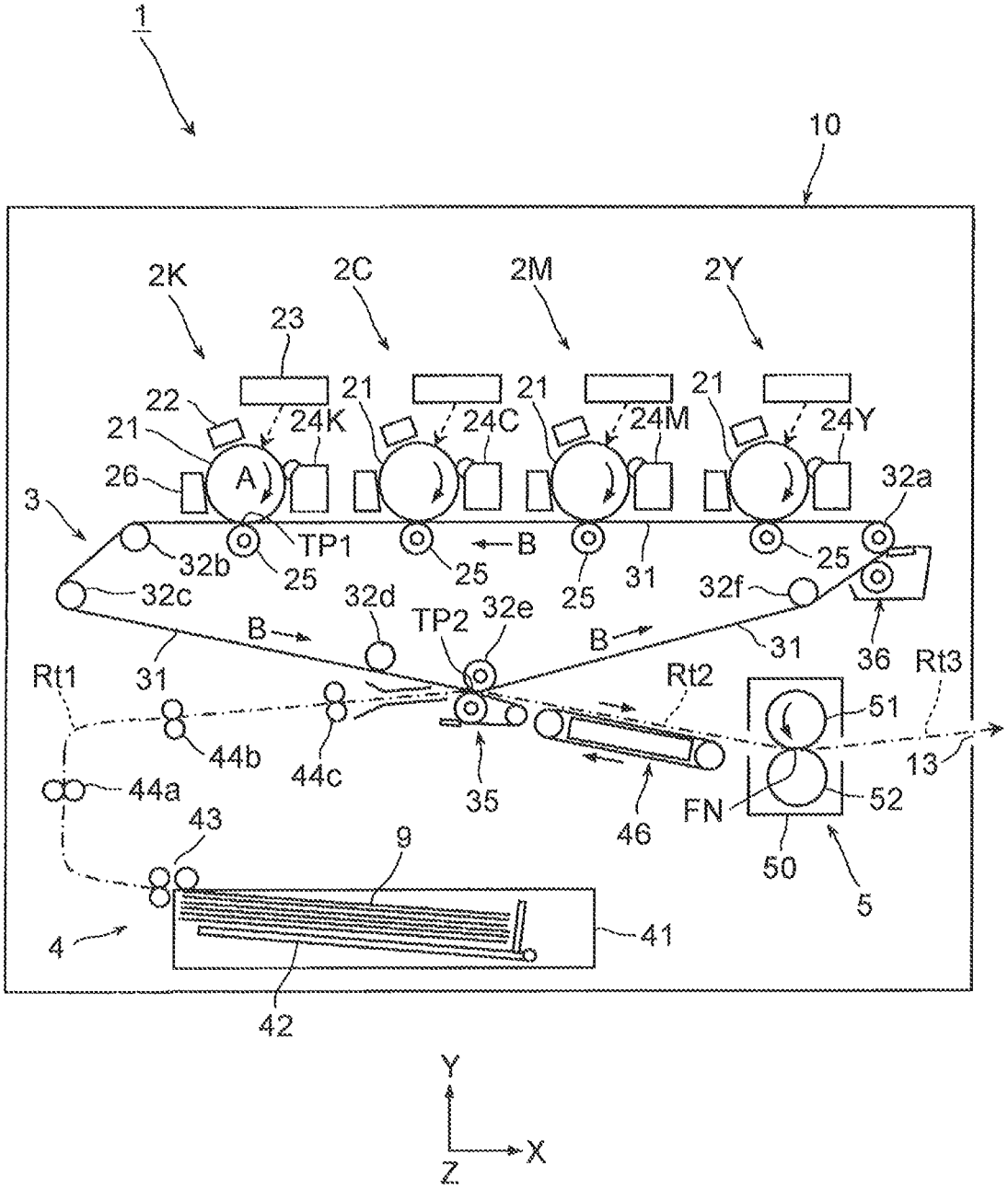
FIG. 1 is a schematic view illustrating the entirety of an image forming apparatus according to a first exemplary embodiment.
Figure 2A:
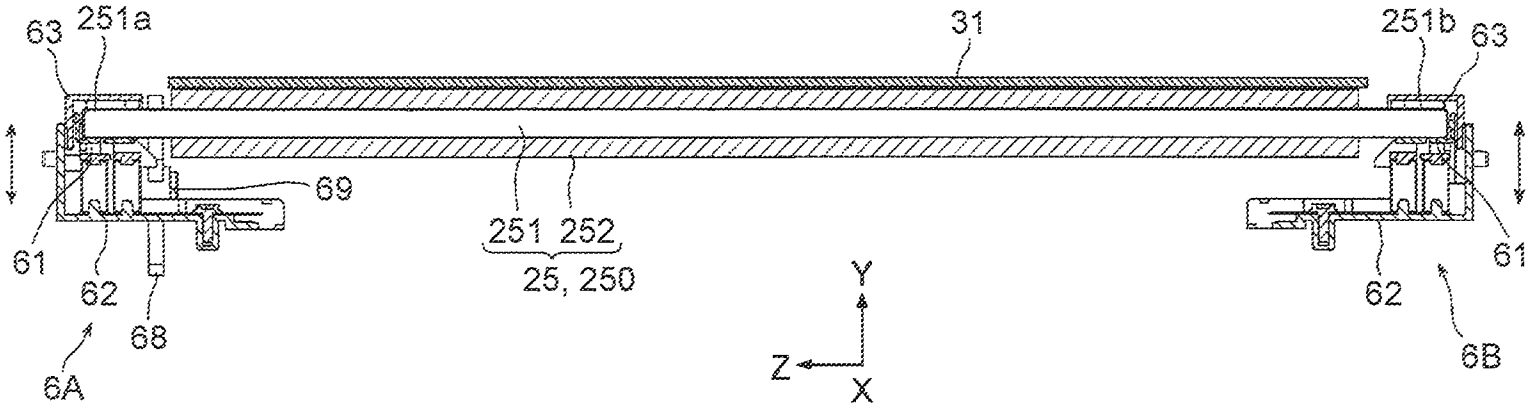
FIGS. 2A and 2B are views illustrating a support structure of a first transfer roller in the image forming apparatus of FIG. 1.
Figure 2B:
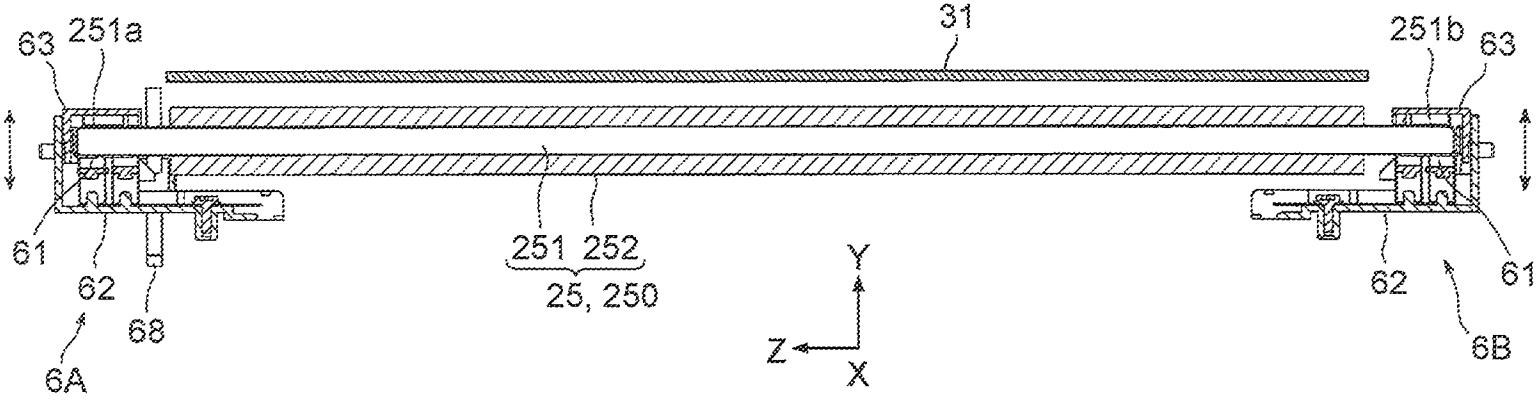

FIGS. 1 and 2 are views illustrating an image forming apparatus 1 according to a first exemplary embodiment. FIG. 1 illustrates the entire configuration of the image forming apparatus 1, and FIGS. 2A and 2B illustrate the configuration of part (primarily, a secondary transfer device and its peripheral area) of the image forming apparatus 1.

The arrows labeled with the symbols X, Y, Z in the drawings such as FIG. 1 indicate the directions of width, height, and depth of three-dimensional space defined in the drawings. In each of the drawings, a circle symbol at the intersection of the arrows in the X and Y (or Y and Z) directions indicates that the Z (or X) direction is toward the vertically downward of the drawing surface.

The image forming apparatus 1 is an apparatus that forms an image composed of toner as a developer on a sheet of paper 9 which is an example of a recording medium. The image forming apparatus 1 in the first exemplary embodiment is implemented as a printer that forms an image corresponding to image information inputted from an external connection device such as an information terminal device, for instance.

As illustrated in FIG. 1, the image forming apparatus 1 has a housing 10 in a desired external shape, and in the internal space of the housing 10, the image forming apparatus 1 includes an image forming device 2 that forms a toner image based on image information; an intermediate transfer device 3 that temporarily holds the image formed by the image forming device 2 then secondarily transfers the image to the sheet of paper 9; a sheet feeding device 4 that stores and supplies sheets of paper 9 to be supplied to the position at which secondary transfer is performed by the intermediate transfer device 3; and a fixing device 5 that fixes a toner image secondarily transferred by the intermediate transfer device 3 to the sheet of paper 9.

The image information is information on an image such as a character, a figure, a photograph, and a pattern, for instance. The housing 10 is a structure formed in a desired shape with various support members and exterior materials. The dashed-dotted line with an arrow in FIG. 1 indicates a primary transport path when the sheet of paper 9 is transported within the housing 10.

The image forming device 2 includes four image forming devices 2Y, 2M, 2C, and 2K that exclusively form toner images of four colors: yellow (Y), magenta (M), cyan (C), and black (K), respectively.

Each of the four image forming devices 2 (Y, M, C, K) has a photoreceptor drum 21 which is an example of an image carrying unit that rotates in the direction indicated by an arrow A, and the image forming device 2 is formed by disposing devices, such as a charging device 22, an exposure device 23, a developing device 24 (Y, M, C, K), a first transfer device 25, and a drum cleaning device 26 in the surroundings of the photoreceptor drum 21. In FIG. 1, the symbols 21 to 26 are labeled to the image forming device 2K for black (K) only, and part of the symbols are labeled to the image forming devices (Y, M, C) for other colors.

Among all, the charging device 22 is a device that charges the outer circumferential surface (surface allowing formation of an image) of the photoreceptor drum 21 to a desired surface potential. The exposure device 23 is a device that performs light exposure on the outer circumferential surface of the photoreceptor drum 21 based on image information, and forms an electrostatic latent image having desired color components (Y, M, C, K). The developing device 24 (Y, M, C, K) is a device that develops the electrostatic latent image formed on the outer circumferential surface of the photoreceptor drum 21 with developer (toner) corresponding predetermined colors (Y, M, C, K), and forms respective toner images of the predetermined four colors. The first transfer device 25 is a device that electrostatically transfers the toner image of each color formed on the outer circumferential surface of the photoreceptor drum 21 to the intermediate transfer device 3 (an intermediate transfer belt 31). The drum cleaning device 26 is a device that scrapes and removes unnecessary toner and unwanted substances, such as paper powder, adhering to the outer circumferential surface of the photoreceptor drum 21 to clean the outer circumferential surface of the photoreceptor drum 21.

In these image forming devices 2 (Y, M, C, K), each location where the photoreceptor drum 21 (in a strict sense, an intermediate transfer belt 31 of the intermediate transfer device 3) and the first transfer device 25 are opposed to each other is a first transfer position TP1 at which the first transfer of a toner image is performed.

The intermediate transfer device 3 is a device configured to carry a toner image of each color by the first transfer, the toner image being formed by the image forming devices 2 (Y, M, C, K), then to transport the toner image to a position at which the second transfer is performed on the sheet of paper 9. The intermediate transfer device 3 is disposed on the upper side of the image forming devices 2 (Y, M, C, K) within the housing 10.

The intermediate transfer device 3 includes an intermediate transfer belt 31 to which a toner image is first transferred from each photoreceptor drum 21 of the image forming devices 2 (Y, M, C, K), and which carries the toner image. The intermediate transfer device 3 is formed by disposing the following devices around the intermediate transfer belt 31.

The intermediate transfer belt 31 is supported by multiple support rollers 32*a* to 32*f* disposed therewithin so as to pass through the first transfer positions of the image forming devices 2 (Y, M, C, K) sequentially and rotate (circumferential movement) in the direction indicated by an arrow B.

The support roller 32*a* is formed as a drive roller which is driven to rotate by receiving rotational power from a driving device (not illustrated), the support roller 32*b* is formed as a surface roller which holds a belt position (surface) near the first transfer position of the intermediate transfer belt 31 in cooperation with the support roller 32*a*, and the support roller 32C is formed as a tension roller. In addition, the support roller 32*d* is formed as a surface roller before the second transfer of the intermediate transfer belt 31, the support roller 32*e* is formed as a second transfer backup roller, and the support roller 32*f* is formed as a surface roller after the second transfer position of the intermediate transfer belt 31 is passed. When the support roller 32*e* is formed as a roller to which a voltage for the second transfer is supplied, the voltage for the second transfer is supplied from a power supply device which is not illustrated.

The first transfer device 25 of each of the image forming devices 2 (Y, M, C, K) is disposed inwardly of the intermediate transfer belt 31. The first transfer device 25 configurates part of the intermediate transfer device 3. As illustrated in FIGS. 1, 2A and 2B, the first transfer device 25 in the first exemplary embodiment is formed by a first transfer roller 250 in a roll form or the like, which presses the intermediate transfer belt 31 against the photoreceptor drum 21 at the first transfer position TP1 to rotate by following the photoreceptor drum 21. A first transfer current is supplied to the first transfer roller 250 from a power supply device which is not illustrated.

A second transfer device 35 is disposed at the outer circumferential surface of a portion, supported by the support roller 32*e*, of the intermediate transfer belt 31. The second transfer device 35 allows the sheet of paper 9 to pass through and secondarily transfers a toner image on the intermediate transfer belt 31 to the sheet of paper 9. The second transfer device 35 is implemented as a device in a form combining two support rollers and a transfer transport belt.

In addition, at the outer circumferential surface of a portion, supported by the support roller 32*a*, of the intermediate transfer belt 31, a belt cleaning device 36 is disposed, which removes unwanted substances such as unnecessary toner adhering to the outer circumferential surface of the intermediate transfer belt 31 to clean the outer circumferential surface of the intermediate transfer belt 31.

In the intermediate transfer device 3, the location where the outer circumferential surface of the intermediate transfer belt 31 is in contact with the second transfer device 35 is a second transfer position TP2 at which the second transfer of a toner image is performed.

The sheet feeding device 4 is a device configured to store and deliver the sheets of paper 9 to be supplied to the second transfer position TP2 of the intermediate transfer device 3. The sheet feeding device 4 is disposed at a position on the lower side of the image forming devices 2 (Y, M, C, K) inside the housing 10.

The sheet feeding device 4 is formed by disposing devices such as a storage body 41 for sheets of paper, and a feeding device 43.

The storage body 41 is a storage member having a stacking plate 42 for storing multiple sheets of paper 9 stacked in a desired orientation, and is mounted to allow an operation such as drawing the storage member to the outside of the housing 10 and loading the sheets of paper 9. The feeding device 43 is a device that delivers the uppermost one of the sheets of paper 9 stacked on the stacking plate 42 of the storage body 41 one by one by sheet delivery devices such as multiple rollers.

The sheet of paper 9 may be a recording medium, such as regular paper, coated paper, or thick paper, which can be transported within the housing 10, and allows transfer and fixing of a toner image, and the quality and form of the recording medium is not particularly restricted.

The fixing device 5 is a device configured to fix a toner image to the sheet of paper 9, the toner image being secondarily transferred by the intermediate transfer device 3. The fixing device 5 is disposed at a lower position on the downstream side in the transport direction of the sheet of paper 9 from the second transfer position TP2 of the intermediate transfer device 3 within the housing 10.

The fixing device 5 is formed by disposing devices, such as a rotational body 51 for heating, and a rotational body 52 for pressurizing, in the internal space of a housing 50 provided with an introduction port and a discharge port for the sheets of paper 9.

The rotational body 51 for heating is a rotational body in a roll form or a belt-pad form, rotatable in the direction indicated by an arrow, and is heated so that the outer circumferential surface is maintained at a desired temperature by a heating unit which is not illustrated. The rotational body 52 for pressurizing is a rotational body in a roll form or a belt-pad form, which comes into contact with the rotational body 51 for heating under a desired pressure, and rotates by following the rotational body 51. The rotational body 52 for pressurizing may be heated by a heating unit.

In the fixing device 5, the location where the rotational body 51 for heating and the rotational body 52 for pressurizing are in contact with each other serves as a nip part (fixing processing part) FN that performs processing such as heating, pressurizing for fixing an unfixed toner image to the sheet of paper 9.

The portion of a dashed-dotted line indicated by a symbol Rt1 in FIG. 1 is a sheet feeding transport path for transporting and feeding the sheet of paper 9 in the sheet feeding device 4 to the second transfer position TP2. The sheet feeding transport path Rt1 is formed by disposing multiple transport rollers 44*a* to 44*c* that pinch and transport the sheet of paper 9, and multiple guiding members (not illustrated) that ensure the transport space for the sheet of paper 9 and guide the transport of the sheet of paper 9.

In addition, the portion of a dashed-dotted line indicated by a symbol Rt2 in FIG. 1 is a relay transport path for relaying and transporting the sheet of paper 9 to the fixing device 5 after the second transfer is completed at the second transfer position TP2 of the intermediate transfer device 3. The relay transport path Rt2 is formed by disposing, for instance, a suction belt transport device 46.

In addition, the portion of a dashed-dotted line indicated by a symbol Rt3 in FIG. 1 is a discharge transport path between the fixing device 5 and a discharge port 13, the discharge transport path for transporting the sheet of paper 9 after completion of fixing to the discharge port 13 for the sheet of paper 9 in the housing 10 and discharging the sheet of paper 9 to a discharge storage which is not illustrated. The discharge transport path Rt3 is formed by disposing a pair of transport rollers, discharge rollers (not illustrated), and multiple guiding members (not illustrated) that guide the transport of the sheet of paper 9.

Image formation by the image forming apparatus 1 is performed, for instance, by the following operations. Here, a description is given using an example where a multi-color image in a combination of toner images of the four colors (Y, M, C, K), what is called a full-color image is formed.

First, in the four image forming devices 2Y, 2M, 2C, 2K, when a start command for an operation of forming a full-color image is received, for each photoreceptor drum 21 which rotates in the direction indicated by an arrow A, a charging operation by the charging device 22, an exposure operation by the exposure device 23, and a developing operation by the developing device 24 (Y, M, C, K) are performed. Thus, each of toner images of four colors composed of the components of the four colors (Y, M, C, K) is individually formed on a corresponding photoreceptor drum 21 in the image forming devices 2Y, 2M, 2C, 2K.

Subsequently, in the intermediate transfer device 3, the toner images of four colors (Y, M, C, K) formed on the photoreceptor drum 21 by the image forming devices 2Y, 2M, 2C, 2K each undergo a first transfer operation performed on the intermediate transfer belt 31 which rotates in the direction indicated by an arrow B, and are transported to the second transfer position TP2, the first transfer operation being performed by the first transfer device 25 at the first transfer position TP1. Meanwhile, the sheet of paper 9 is transported to the second transfer position TP2 from the sheet feeding device 4 through the sheet feeding transport path Rt1. Thus, the toner images of four colors (Y, M, C, K) on the intermediate transfer belt 31 are secondarily transferred to the sheet of paper 9 by a second transfer operation performed by the second transfer device 35.

Subsequently, the sheet of paper 9 after completion of the second transfer is transported to the fixing device 5 through the relay transport path Rt2, and is introduced to and passed through a fixing processor in the fixing device 5. Thus, the sheet of paper 9 undergoes fixing processing by the fixing device 5, and a toner image is fixed to the sheet of paper 9.

Finally, the sheet of paper 9 after completion of the fixing is discharged to a discharge storage (not illustrated) through the discharge transport path Rt3.

A sheet of paper 9 with a full-color image formed is outputted by the above operations.

In the image forming apparatus 1, when a command for an operation of forming a full-color image on multiple sheets of paper 9 is received, the series of operations described above are repeated for a specified number of sheets. Incidentally, with the image forming apparatus 1, it is also possible to form a single-color image such as a black image.

The first transfer roller 250 of the first transfer device 25 in the image forming apparatus 1 has the support structure as described in the following.

First, as illustrated in FIGS. 2A and 2B, FIGS. 3A and 3B, the first transfer roller 250 includes a circular rod-like rotational shaft 251 having electrical conductivity, and a semiconductive elastic layer 252 which is formed in the range of the rotational shaft 251 excluding both end portions (ends) 251*a*, 251*b* in the shaft center direction.

Next, in the first transfer roller 250, as illustrated in FIGS. 2A and 2B, FIGS. 3A and 3B, the both ends 251*a*, 251*b* of the rotational shaft 251 are rotatably supported by bearings 61 which are each movably supported by a support frame 62 between a use position of the first transfer roller 250 and a retraction position away from the use position, the support frame 62 being an example of a support unit.

Here, the use position of the first transfer roller 250 is the position at which the first transfer roller 250 comes into contact with the intermediate transfer belt 31 at the first transfer position TP1 and assumes a state in which the intermediate transfer belt 31 is pressed against the photoreceptor drum 21 and the first transfer operation can be performed.

In contrast, the retraction position of the first transfer roller 250 is the position when the first transfer roller 250 assumes a state of being away from the intermediate transfer belt 31 by a desired distance. The retraction position is used, for instance, when the intermediate transfer device 3 is a unit drawable from the housing 10 and is drawn, or when the image forming apparatus 1 is transported. The transport includes a transportation operation by a vehicle such as a truck, and a carry-in operation of the image forming apparatus 1 to an installation site.

As illustrated in FIGS. 3A and 3B to FIGS. 6A and 6B, the bearing 61 in the first exemplary embodiment has a structure including main body portions 611, a spring receiving surface portion 612, and a side wall surface portion 615.

Among these portions, the main body portions 611 are provided with a U-shaped cross sectional bearing surface comprised of a plain bearing to which the ends 251*a*, 251*b* of the rotational shaft 251 are fitted from the above, and guide grooves 613 which extend linearly in a vertical direction on respective outer sides of the side wall portions between which the rotational shaft 251 is interposed.

The spring receiving surface portion 612 is a portion that is provided below the main body portion 611, and has a projection 612*a* and a surface which receives the upper end of springs 64 (FIGS. 3A and 3B) that urge the main body portion 611 upward toward the intermediate transfer belt 31.

The side wall surface portions 615 are plate-like portions provided in a state of standing from lower positions of the main body portion 611 to be opposed to end faces 251*c* of the ends 251*a*, 251*b* of the rotational shaft 251 with desired respective intervals.

Figure 4:
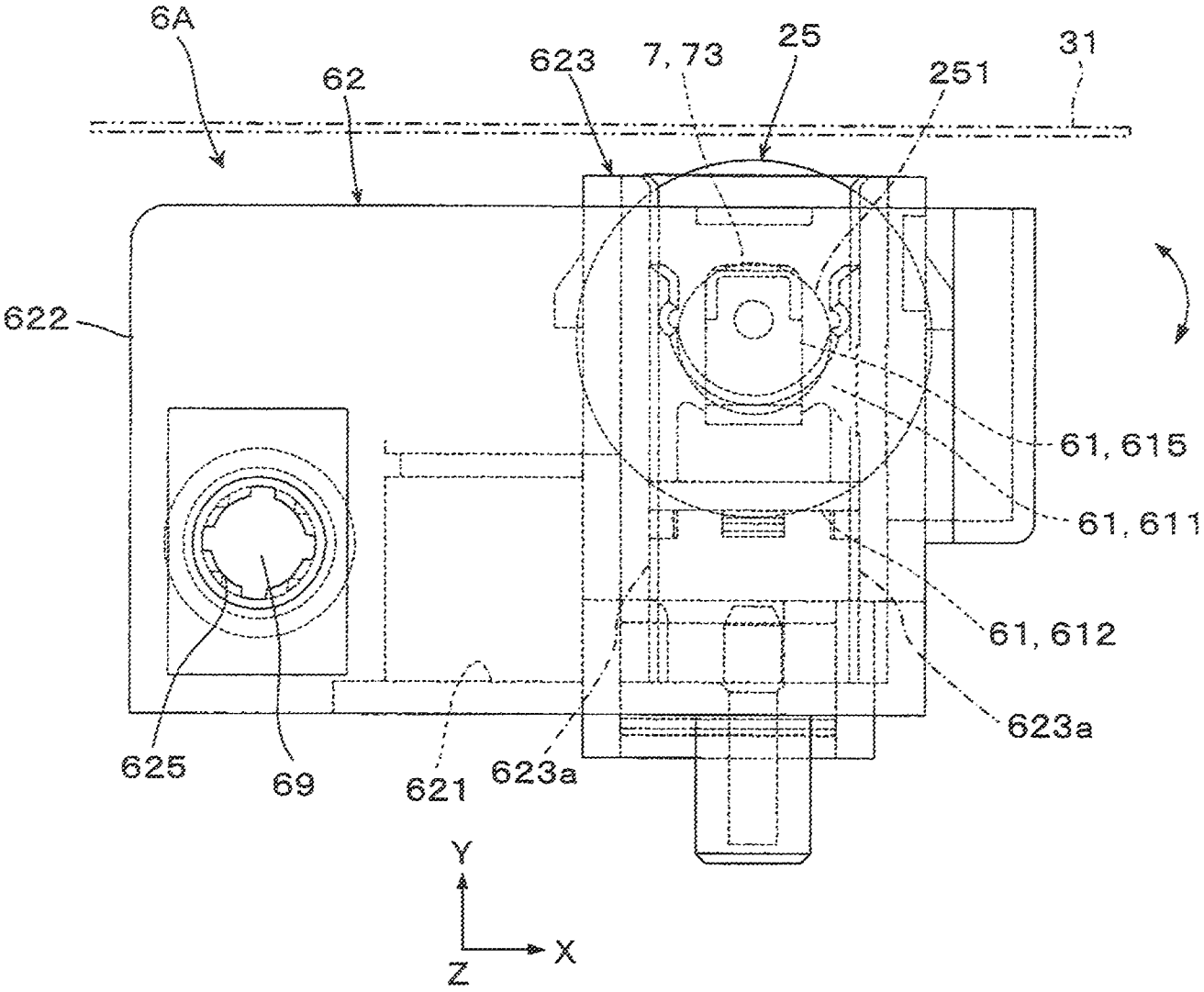
FIG. 4 is a front view illustrating part of the support structure of the first transfer roller in a transparent manner.
Figure 6A:
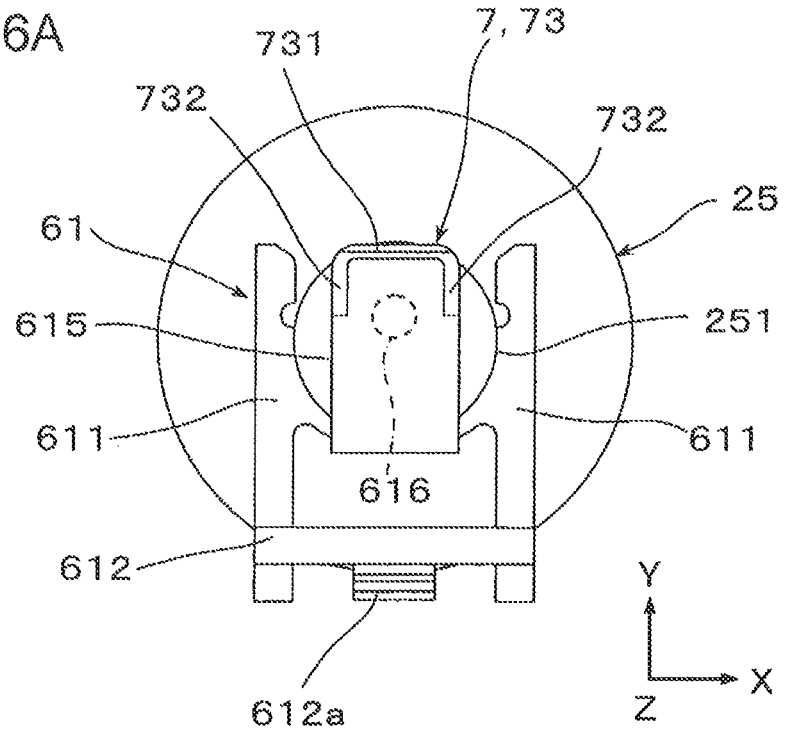
FIG. 6A is a front view illustrating a bearing of the first transfer roller.
Figure 6B:
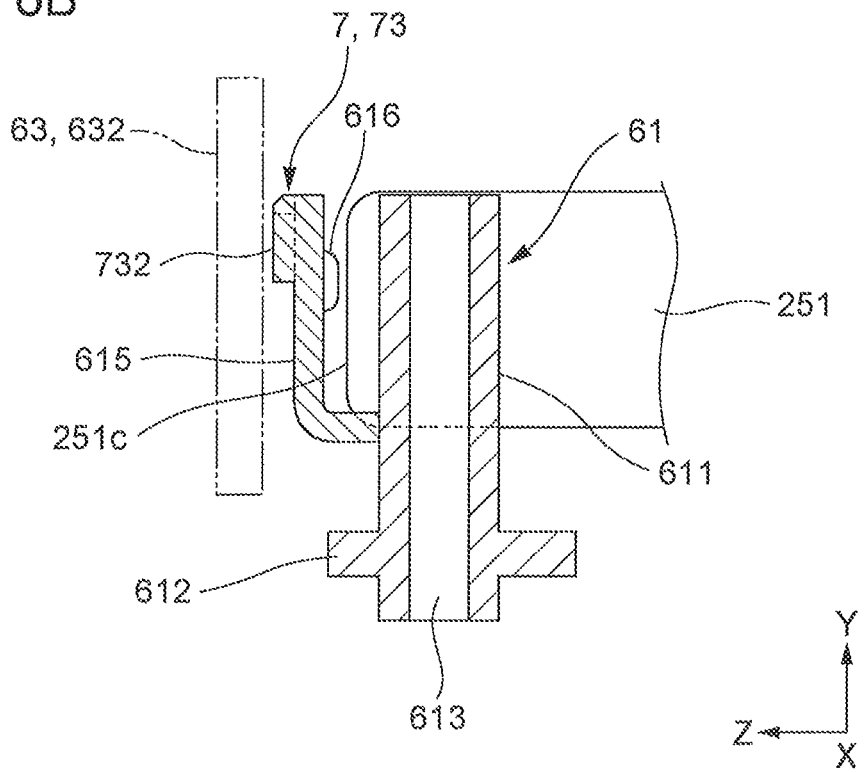
FIG. 6B is a side view illustrating the bearing of FIG. 6A.

The side wall surface portions 615 restrict unnecessary movement of the rotational shaft 251 in the directions to both ends, and serve as positioning sections for positioning in the shaft center direction of the first transfer roller 250. As illustrated in FIG. 4, FIGS. 6A and 6B, inward face portions opposed to the end faces 251*c* of the rotational shaft 251 are each provided with a projection 616 that projects closer to a corresponding end face 251*c*.

Incidentally, the reason why each side wall surface portion 615 is not contact with and spaced from a corresponding end face 251*c* of the rotational shaft 251 is that the rotation of the rotational shaft 251, eventually of the first transfer roller 250 is not prevented by the side wall surface portion 615.

As illustrated in FIGS. 3A and 3B to FIG. 5, the support frame 62 in the first exemplary embodiment has a structure including a base plate portion 621 that extends substantially parallel to the shaft center direction of the rotational shaft 251; side plate portions 622 that stand upward at ends of the base plate portion 621 outside the ends 251*a*, 251*b* of the rotational shaft 251; and pairs of guide supports 623 that face to each other and stand upward to interpose the respective both ends 251*a*, 251*b* of the rotational shaft 251 at positions inside the side plate portions 622.

Figure 3A:
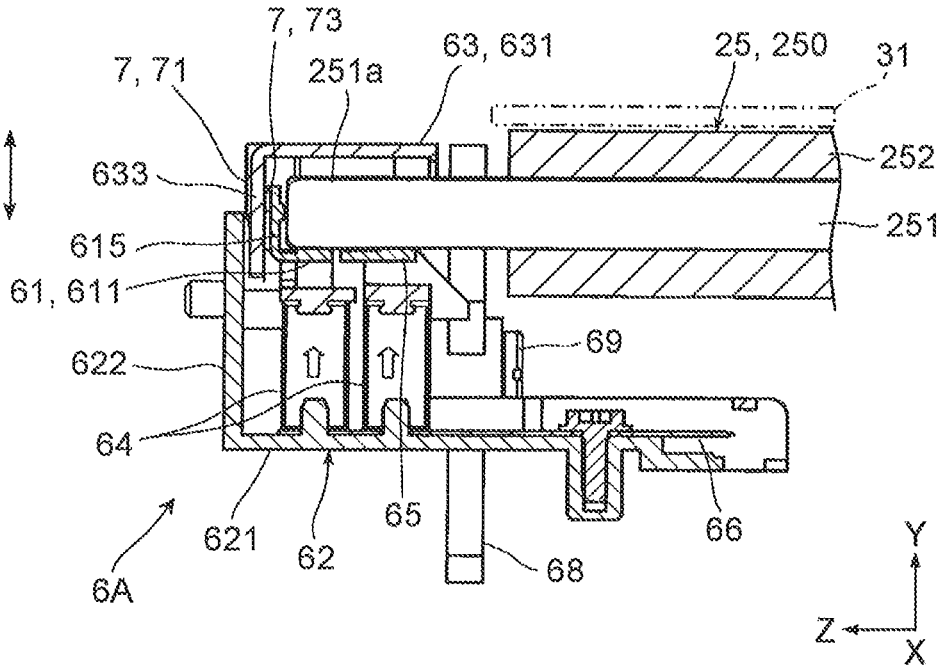
FIG. 3A is a schematic cross-sectional view illustrating part of the first transfer roller on a larger scale when moved to the use position.
Figure 3B:
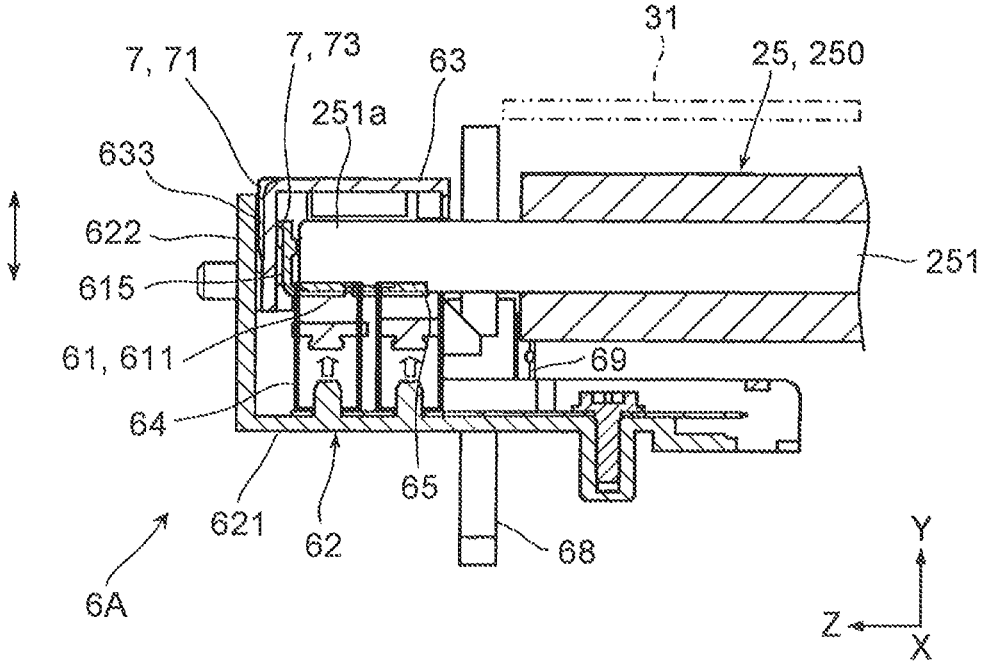
FIG. 3B is a schematic cross-sectional view illustrating part of the first transfer roller on a larger scale when moved to the retraction position.

Among these portions, the base plate portion 621 is formed as a portion that extends to a position opposed to the elastic layer 252 of the first transfer roller 250. In addition, the portion of the base plate portion 621, facing the projection 612*a* of each spring receiving surface portion 612 of the bearing 61 is provided with a projection and a surface that receives the lower end of the springs 64. For instance, a coil spring is applied to each spring 64, and as illustrated in FIGS. 3A and 3B, the spring 64 is disposed in a state of being present between the spring receiving surface portion 612 of the bearing 61 and the base plate portion 621, and present between a pair of guide supports 623. Thus, as illustrated by white arrows in FIGS. 3A and 3B, the spring 64 acts to urge (the main body portion 611 of) the bearing 61 upward toward the intermediate transfer belt 31.

As illustrated in FIGS. 3A and 3B, FIG. 4, each side plate portion 622 is configured such that the upper end thereof has an appropriate height so as to be opposed to at least part of an end face 251*c* of the rotational shaft 251 in the first transfer roller 250 at the use position with the side wall surface portion 615 of the bearing 61 interposed between the upper end and the first transfer roller 250. As illustrated in FIG. 4, a shaft mounting hole is provided, to which a support shaft 69 of a swing support plate 68 is fitted and fixed, the swing support plate 68 causing the first transfer roller 250 to be displaced so as to be in contact with or separated from the intermediate transfer belt 31.

The inner side walls opposed to each other of each pair of guide supports 623 are provided with a guide protruding bar 623*a* that extends linearly to guide the bearing 61 for sliding in the vertical direction with the protruding bar 623*a* fitted to a corresponding guide groove 613 in the main body portion 611 of the bearing 61.

As illustrated in FIGS. 3A and 3B, FIG. 4, the bearing 61 is movably supported so as to be guided in the vertical direction with the protruding bar 623*a* in each pair of guide supports 623 of the support frame 62 fitted into the guide groove 613 of the main body portion 611. The bearing 61 is also maintained in a state of being urged by a desired upward urging force by the spring 64.

Also, swinging of the swing support plate 68 in a desired direction causes the side plate portion 622 of the support frame 62 to swing similarly via the support shaft 69. Thus the first transfer roller 250 mounted on the support frame 62 with the bearing 61 interposed therebetween is designed to be displaced so as to be in contact with or separated from the intermediate transfer belt 31. Although the swing support plate 68 is not illustrated in the vicinity of the right-side end of the first transfer roller 250 in FIGS. 2A and 2B, actually, the swing support plate 68 is also disposed in the vicinity of the right-side end of the first transfer roller 250.

Separation of the first transfer roller 250 from the intermediate transfer belt 31 is performed by swinging of the swing support plate 68, for instance, when a toner image is not formed by an image forming device 2 (Y, M, C, K) in which the first transfer roller 250 is disposed.

Figure 5:
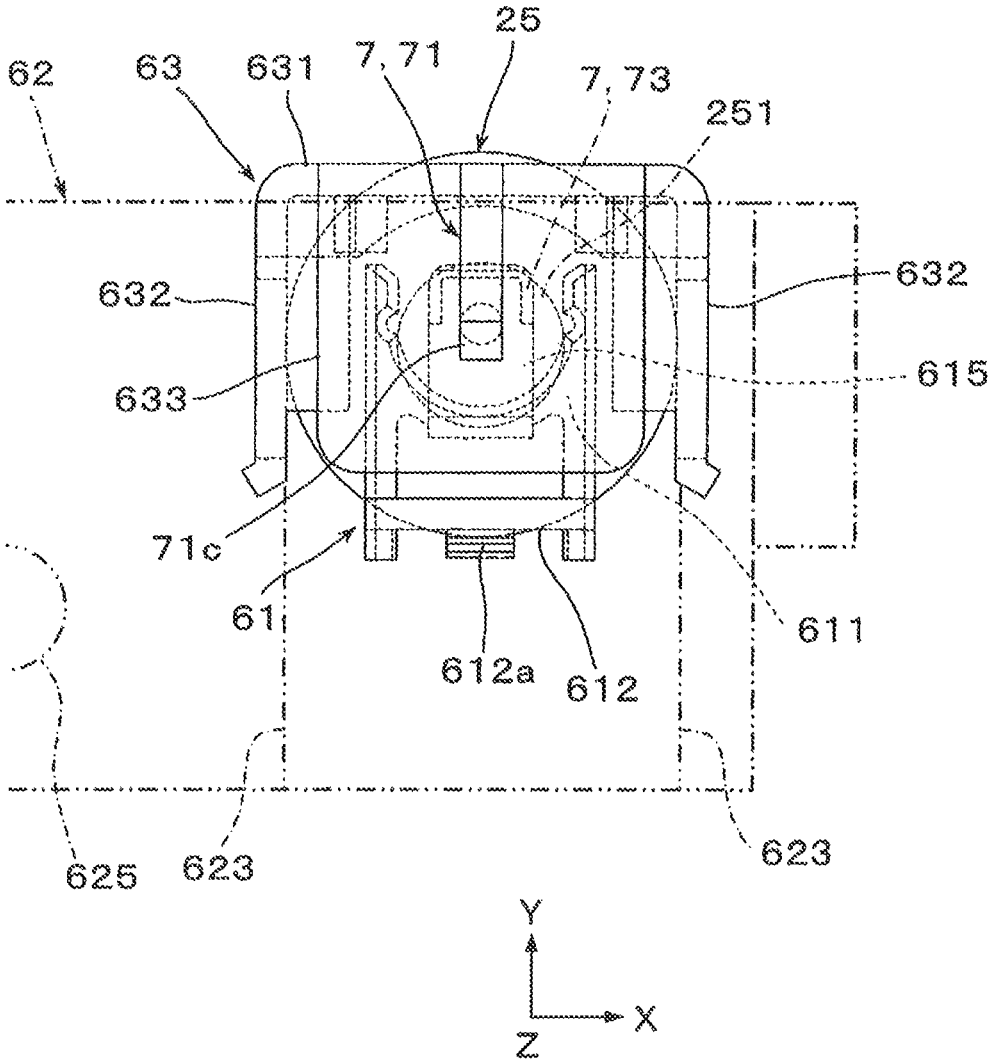
FIG. 5 is a front view illustrating part of the support structure of FIG. 4.

As illustrated in FIGS. 3A and 3B, and FIG. 5, in the support structure of the first transfer roller 250 in the first exemplary embodiment, a covering part 63 is provided to cover the upper side and the lateral side of the ends 251*a*, 251*b* of the rotational shaft 251 and the bearing 61, the covering part 63 being an example of an attached component. The covering part 63 is made of, for instance, an electrically non-conductive member.

The covering part 63 in the first exemplary embodiment has a structure including a ceiling plate portion 631; a pair of side plate portions 632 extending down from side ends of the ceiling plate portion 631 and disposed to face each other interposing the ends 251*a*, 251*b* of the rotational shaft 251 and the main body portion 611 of the bearing 61; and an end face plate portion 633 extending down from an end of the ceiling plate portion 631 and disposed to face the end face 251*c* of the rotational shaft 251 with an interval.

Among these portions, the ceiling plate portion 631 is a plate-like portion having a width between positions away from the rotational shaft 251 and outside of the main body portion 611 of the bearing 61, and a length from the inner side of the side plate portion 622 of the support frame 62 to the outer side of the swing support plate 68.

The pair of side plate portions 632 are plate-like portions each extending down from both ends of the ceiling plate portion 631 in the width direction and each having an approximate height dimension to cover the main body portion 611 of the bearing 61 from the outside.

The end face plate portion 633 is in a state of extending down from the outer-side end of the ceiling plate portion 631 in the length direction and being present between the side wall surface portion 615 of the bearing 61 and the side plate portion 622 of the support frame 62. The end face plate portion 633 is a plate-like portion having an approximate height dimension to cover the end face 251*c* of the rotational shaft 251 from the outside. The end face plate portion 633 is disposed to be opposed to both the side wall surface portion 615 of the bearing 61 and the side plate portion 622 of the support frame 62 with a desired interval (with a space).

Part (the side plate portion 622) of the covering part 63 is connected to the main body portion 611 of the bearing 61, and is supported movably in the vertical direction along with the bearing 61 by the guide supports 623 of the support frame 62.

In addition, in the support structure of the first transfer roller 250, as illustrated in FIGS. 3A and 3B, a power feeding terminal 65 for supplying a voltage for the first transfer is disposed in a state of contact with the lower surfaces, inward of the bearing 61, of the ends 251*a*, 251*b* of the rotational shaft 251.

The power feeding terminal 65 is made of an electrically conductive member, and is maintained in a state of being urged and pressed against the ends 251*a*, 251*b* of the rotational shaft 251 by the spring 64 having electrical conductivity. In addition, the power feeding terminal 65 is designed to be energized with a voltage for the first transfer supplied from a power feeding device (not illustrated) via a power transmission plate which is fixedly disposed to the base plate portion 621 of the support frame 62.

In the support structure of the first transfer roller 250 in the image forming apparatus 1, when the image forming apparatus 1 is transported, as illustrated in FIG. 2B, the first transfer roller 250 is set in a state of being moved to the retraction position.

In this process, the first transfer roller 250 moved to the retraction position is in a state where the elastic layer 252 is separated from the outer circumferential surface of the intermediate transfer belt 31 by a desired distance.

Also, in this process, the ends 251*a*, 251*b* of the rotational shaft 251 of the first transfer roller 250 are in a state of being moved by a desired distance to the lower side closer to the base plate portion 621 of the support frame 62 along with the bearing 61 and its attached component, that is, the covering part 63. Consequently, the ends 251*a*, 251*b* of the rotational shaft 251 moved to the retraction position are in a state to be closer and opposed to the side plate portion 622 of the support frame 62 along with the side wall surface portion 615 of the bearing 61 and the end face plate portion 633 of the covering part 63 (FIGS. 8A and 8B).

Figure 8A:
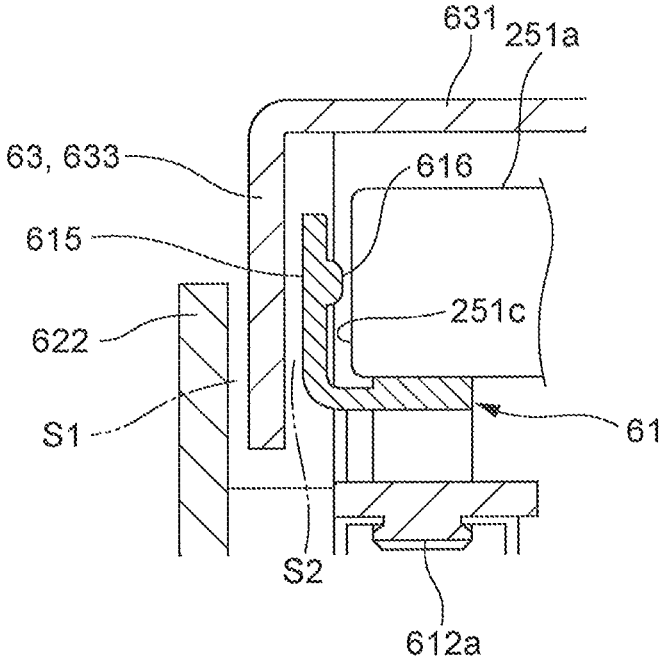
FIG. 8A is a schematic view illustrating a state of the vicinity of an end of the first transfer roller on a larger scale when moved to the use position in a comparative example (a configuration example in which a contact portion is not provided)
Figure 8B:
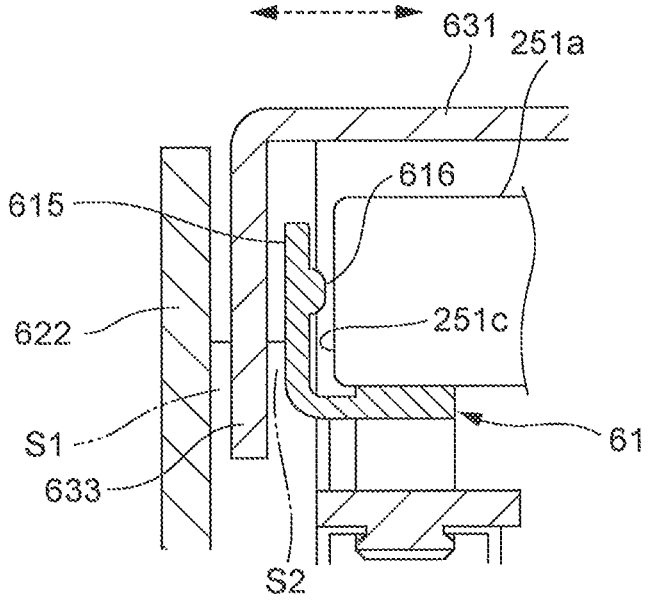
FIG. 8B is a schematic view illustrating a state of the vicinity of an end of the first transfer roller on a larger scale when moved to the retraction position in a comparative example.

Furthermore, when the first transfer roller 250 is moved to the retraction position, as illustrated in FIGS. 8A and 8B, the end face plate portion 633 of the covering part 63 is in a state of having space S1 between itself and the end face plate portion 633 of the covering part 63, as well as in a state of having space S2 between itself and the side wall surface portion 615 of the bearing 61. Also, at this point, the first transfer roller 250 itself is in a state of slightly displaceable in the shaft center direction.

When the image forming apparatus 1 is transported in such a state where the spaces s1, S2 are present, if an irregular external force is received at the time of transportation, the first transfer roller 250 is moved irregularly in the shaft center direction, thus the end face 251*c* of the rotational shaft 251 of the first transfer roller 250 may collide with the side wall surface portion 615 of the bearing 61, and may further collide with the end face plate portion 633 of the covering part 63, and eventually with the side plate portion 622 of the support frame 62 via the side wall surface portion 615 of the bearing 61, and an unexpected impact may be caused.

In this case, when the impact due to the collision is intense, for instance, the side wall surface portion 615 of the bearing 61 and/or the end face plate portion 633 of the covering part 63 may be damaged or broken.

Thus, in the image forming apparatus 1, as illustrated in FIGS. 3A and 3B to FIGS. 6A and 6B, the bearing 61 and the covering part 63 are each provided with a contact portion 7 which comes into contact with part (the side plate portion 622 and the side wall surface portion 615) of the support frame 62 and the bearing 61, the part being opposed to the bearing 61 and the covering part 63 when the first transfer roller 250 is moved to the retraction position.

As the contact portion 7, a first contact portion 71 which is provided in the end face plate portion 633 the covering part 63 and comes into contact with part (the side plate portion 622) of the support frame 62, and a second contact portion 73 which is provided in the side wall surface portion 615 of the bearing 61 and comes into contact with part (the end face plate portion 633) of the covering part 63 are used.

As illustrated in FIGS. 3A and 3B, FIG. 5, FIGS. 7A and 7B, the first contact portion 71 is provided as a rectangular bulged portion (or projection portion) on the end face plate portion 633 of the covering part 63, the bulged portion extending linearly in the vertical direction.

Figure 7A:
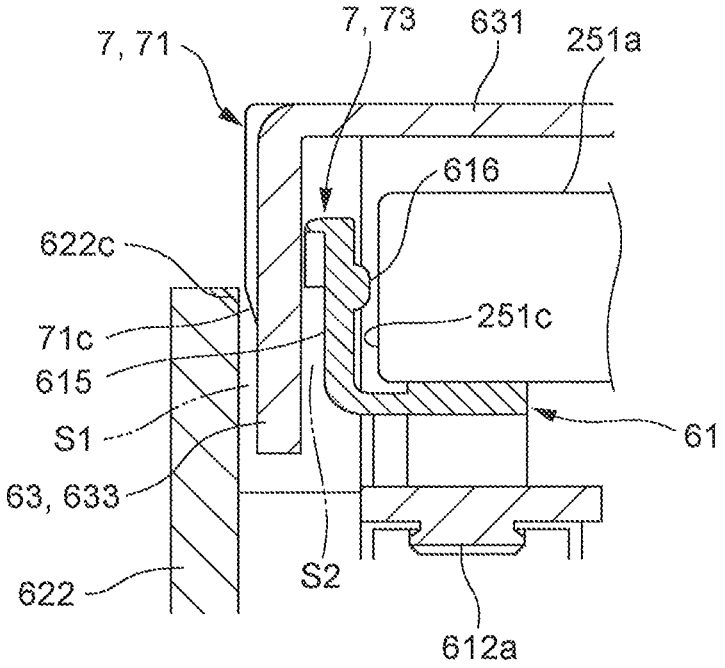
FIG. 7A is a schematic view illustrating a state of the vicinity of an end of the first transfer roller on a larger scale when moved to the use position.
Figure 7B:
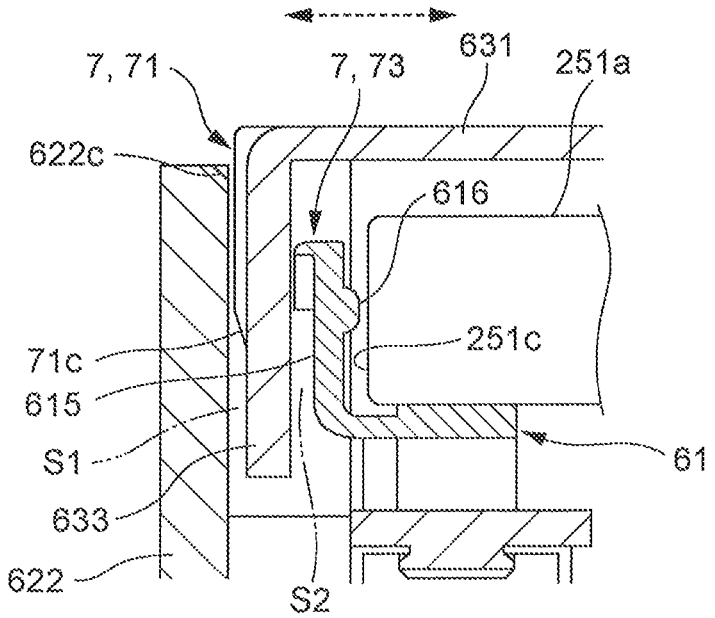
FIG. 7B is a schematic view illustrating a state of the vicinity of an end of the first transfer roller on a larger scale when moved to the retraction position.

As illustrated in FIGS. 7A and 7B, the first contact portion 71 enters space S1, and is formed in a state of bulge or projection with a height at which a state of contact of the first contact portion 71 with the inner side surface of the side plate portion 622 of the support frame 62 is maintained, the space S1 being present between the end face plate portion 633 of the covering part 63 and the side plate portion 622 of the support frame 62.

The first contact portion 71 is provided in a shape from the upper end of the end face plate portion 633 of the covering part 63, the shape having a portion present at a position facing part of the end face 251*c* of the rotational shaft 251. Thus, when the end face 251*c* of the rotational shaft 251 indirectly collides with the end face plate portion 633 of the covering part 63, the impact to the end face plate portion 633 of the covering part 63 and the side plate portion 622 of the support frame 62 is reliably reduced, as compared with when the first contact portion 71 is in a shape not having a portion present at the position.

As illustrated in FIG. 3A, the first contact portion 71 is provided so as not to be in contact with the side plate portion 622 of the support frame 62 when the first transfer roller 250 is moved to the use position.

In addition, as illustrated in FIGS. 7A and 7B, the first contact portion 71 is configurated in a shape having an inclined face (tapered face) 71*c* that, when moved to the retraction position, gradually comes closer to the side plate portion 622 of the support frame 62, which is to be opposed to and in contact with the first contact portion 71.

In the first exemplary embodiment, as illustrated in FIGS. 7A and 7B, an inclined face 622*c*, which descends to gradually come closer to the end face plate portion 633 of the covering part 63, is provided at the upper end, passed by the first contact portion 71, of the side plate portion 622 of the support frame 62. The inclined face 622*c* is used as a guiding face for smoothly introducing the first contact portion 71.

In contrast, as illustrated in FIGS. 3A and 3B to FIGS. 7A and 7B, the second contact portion 73 is provided as a bulged portion (or projection portion) in an inverted U-shape at the side wall surface portion 615 of the bearing 61.

As illustrated in FIGS. 7A and 7B, the second contact portion 73 intervenes in space S2, and is formed in a state of bulge or projection with a height at which a state of contact of the second contact portion 73 with the inner side surface of the end face plate portion 633 of the covering part 63 is maintained, the space S2 being present between the side wall surface portion 615 of the bearing 61 and the end face plate portion 633 of the covering part 63.

The second contact portion 73 is provided in a shape having a portion present at a position facing the end face 251*c* of the rotational shaft 251. As illustrated in FIGS. 6A and 6B, the second contact portion 73 in the first exemplary embodiment is configured in a shape including a horizontal surface portion 731, and a pair of side wall surface portions 732 extending down from the right and left ends of the horizontal surface portion 731. Thus, in the second contact portion 73 in this case, both the horizontal surface portion 731 and the pair of side wall surface portions 732 are present at positions facing the end face 251*c* of the rotational shaft 251.

In addition, as illustrated in FIGS. 6A and 6B, the second contact portion 73 is provided in a state of being present at least at a bent terminal end (an upper end in the first exemplary embodiment) of the side wall surface portion 615 of the bearing 61.

In the image forming apparatus 1 provided with the contact portion 7 (71, 73) as described above, when the first transfer roller 250 is in a state of being moved to the retraction position as illustrated in FIG. 2B at the time of transportation of the image forming apparatus 1, the impact of a collision of the ends 251*a*, 251*b* of the rotational shaft 251 of the first transfer roller 250 with components is reduced, as compared with when the contact portion 7 (71, 73) is not provided, the components being present in the vicinity of the ends 251*a*, 251*b* with an interval and including the side wall surface portion 615 of the bearing 61 and the end face plate portion 633 of the covering part 63.

Specifically, in the image forming apparatus 1, when the first transfer roller 250 is moved to the retraction position, as illustrated on a larger scale in FIG. 7B, the first contact portion 71 enters the space S1 present between the end face plate portion 633 of the covering part 63 and the side plate portion 622 of the support frame 62, and is maintained in a state of contact with the inner side surface of the side plate portion 622 of the support frame 62. In the case including when moved to the use position, the second contact portion 73 intervenes in the space S2 present between the side wall surface portion 615 of the bearing 61 and the end face plate portion 633 of the covering part 63, and is maintained in a state of contact with the inner side surface of the end face plate portion 633 of the covering part 63.

Thus, when an irregular external force is received at the time of transportation, even if the first transfer roller 250 is moved irregularly in the shaft center direction, and the end face 251*c* of the rotational shaft 251 collides with the side wall surface portion 615 of the bearing 61, the above-described space S1 and space S2 are in an absent state, thus the impact of a collision with the side wall surface portion 615 of the bearing 61 is reduced or prevented from being applied to the end face plate portion 633 of the covering part 63 and the side plate portion 622 of the support frame 62 through the side wall surface portion 615 of the bearing 61.

As a consequence, even when the impact due to the collision is intense, the possibility of damage or breakage of the side wall surface portion 615 of the bearing 61 and the end face plate portion 633 of the covering part 63, for instance, is also reduced.

In the image forming apparatus 1, the first contact portion 71 is provided, which comes into contact with the side plate portion 622 that is part of the support frame 62. Thus, as compared with when the first contact portion 71 is not provided, the impact of a collision of the ends 251*a*, 251*b* of the rotational shaft 251 of the first transfer roller 250 with the side plate portion 622 of the support frame 62 is reliably reduced.

In the image forming apparatus 1, the second contact portion 73 is provided, which comes into contact with the side plate portions 632 that is part of the covering part 63. Thus, as compared with when the second contact portion 73 is not provided, the impact of a collision of the ends 251*a*, 251*b* of the rotational shaft 251 of the first transfer roller 250 with part of the side wall surface portion 615 of the bearing 61 is reliably reduced.

In addition, in the image forming apparatus 1, the first contact portion 71 is provided so as not to be in contact with the side plate portion 622 of the support frame 62 when the first transfer roller 250 is moved to the use position. Thus, as compared with when the first contact portion 71 is not provided in such a manner, when the first transfer roller 250 is moved to the use position, there is no possibility of restricting and interfering with the rotational operation of the first transfer roller 250 due to an unexpected contact of the first contact portion 71 with the side plate portion 622 of the support frame 62.

Also, in the image forming apparatus 1, the first contact portion 71 is configurated in a shape having the inclined face 71*c* that, when moved to the retraction position, gradually comes closer to the side plate portion 622 of the support frame 62, which is to be opposed to and in contact with the first contact portion 71. Thus, as compared with when the first contact portion 71 is not configurated in a shape having the inclined face 71*c*, when the first transfer roller 250 is moved to the retraction position, the operations of the bearing 61 and the covering part 63 moved together with the first transfer roller 250 are not interfered with, and performed smoothly.

In addition, in the image forming apparatus 1, the second contact portion 73 is provided in a shape having a portion present at a position facing the end face 251*c* of the rotational shaft 251. Thus, as compared with when the second contact portion 73 is not configurated in a shape having a portion present at such a position, when the end face 251*c* of the rotational shaft 251 directly collides with the end face plate portion 633 of the covering part 63, the impact to the end face plate portion 633 of the covering part 63 and the side plate portion 622 of the support frame 62 adjacent to the end face plate portion 633 is reliably reduced.

In the image forming apparatus 1, the second contact portion 73 is provided in a state of being present at least at a bent upper end of the side wall surface portion 615 of the bearing 61. Thus, as compared with when the second contact portion 73 is not provided in a state of being present at the upper end, the impact of a collision of the end face 251*c* of the rotational shaft 251 with part of the side wall surface portion 615 of the bearing 61 is reliably reduced.

Other Exemplary Embodiments

The present disclosure is not limited to the contents illustrated in the first exemplary embodiment, and, for instance, may include the modifications as described below.

The contact portion 7 may be provided in the side plate portion 622 of the support frame 62. In this case, the second contact portion 73 is desirably provided.

The contact portion 7 may be provided in the side plate portion 622 of the support frame 62 in addition to the side wall surface portion 615 of the bearing 61 and the end face plate portion 633 of the covering part 63. In this case, the contact portion 7 in the side plate portion 622 of the support frame 62 may be provided at a position facing the contact portion provided in the end face plate portion 633 of the covering part 63, or may be provided at a position not facing the contact portion.

In addition, the support structure of the roller provided with the contact portion 7 is not limited to the support structure of the first transfer roller 250, and may be the support structure of other rollers in the image forming apparatus 1.

An apparatus in another form or type may be used as the image forming apparatus 1.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a roller including a rotational shaft supported by a bearing;

a support unit that movably supports the bearing and an attached component of the bearing such that the roller can move between a use position of the roller and a retraction position of the roller away from the use position; and a contact portion that is provided in either one of:

the bearing; and the attached component;

wherein the contact portion is configured such that, if the roller is in the retraction position, then, if the contact portion is provided in the attached component, the contact portion contacts part of the support unit and, if the contact portion is provided in the bearing, the contact portion contacts the attached component opposed to the bearing.

2. The image forming apparatus according to claim 1, wherein the contact portion includes a first contact portion configured to, if the roller is in the retraction position, then contact part of the support unit.

3. The image forming apparatus according to claim 1, wherein the bearing is opposed to an end of the rotational shaft, wherein the bearing has a positioning section configured to, if the rotational shaft is displaced, then restrict a position of the end, and wherein the contact portion includes a second contact portion configured to contact part of the attached component or the positioning section.

4. The image forming apparatus according to claim 2, wherein the bearing is opposed to an end of the rotational shaft, wherein the bearing has a positioning section configured to, if the rotational shaft is displaced, then restrict a position of the end, wherein the contact portion includes a second contact portion configured to contact part of the attached component or the positioning section.

5. The image forming apparatus according to claim 2, wherein the first contact portion is configured such that, if the bearing and the attached component are moved to the use position, then the first contact portion is not in contact with the support unit.

6. The image forming apparatus according to claim 2, wherein the first contact portion is configured to have a shape having an inclined face configured to, if the roller is in the retraction position, then gradually come closer to the part of the support unit to be opposed to and in contact with the first contact portion.

7. The image forming apparatus according to claim 5, wherein the first contact portion is configured to have a shape having an inclined face configured to, if the roller is in the retraction position, then gradually come closer to the part of the support unit to be opposed to and in contact with the first contact portion.

8. The image forming apparatus according to claim 3, wherein the second contact portion is configured to have a shape having a portion present at a position facing an end face of the rotational shaft.

9. The image forming apparatus according to claim 4, wherein the second contact portion is configured to have a shape having a portion present at a position facing an end face of the rotational shaft.

10. The image forming apparatus according to claim 3, wherein the positioning section is configured to have a shape bent from the bearing to face the end face of the rotational shaft, and wherein the second contact portion is provided at least at a bent terminal end of the positioning section.

11. The image forming apparatus according to claim 4, wherein the positioning section is configured to have a shape bent from the bearing to face the end face of the rotational shaft, and wherein the second contact portion is provided at least at a bent terminal end of the positioning section.

12. The image forming apparatus according to claim 8, wherein the positioning section is configured to have a shape bent from the bearing to face the end face of the rotational shaft, and wherein the second contact portion is provided at least at a bent terminal end of the positioning section.

13. The image forming apparatus according to claim 9, wherein the positioning section is configured to have a shape bent from the bearing to face the end face of the rotational shaft, and wherein the second contact portion is provided at least at a bent terminal end of the positioning section.

14. An image forming apparatus comprising:

a roller including a rotational shaft supported by a bearing;

a support configured to movably support the bearing and an attached component of the bearing such that the roller can move between a use position of the roller and a retraction position of the roller away from the use position; and a contact portion that is provided in either one of:

the bearing; and the attached component;

wherein the contact portion is configured such that, if the roller is in the retraction position, then, if the contact portion is provided in the attached component, the contact portion contacts part of the support and, if the contact portion is provided in the bearing, the contact portion contacts the attached component opposed to the bearing.

* * * * *